US005685657A

United States Patent [19]

Jablonski

[11] Patent Number: 5,685,657

[45] Date of Patent: Nov. 11, 1997

[54] PRINTER BELT DRIVE FOR MOVING A CARD

[75] Inventor: Richard Jablonski, Rancho Palos Verdes, Calif.

[73] Assignee: Mag-Tek, Inc., Carson, Calif.

[21] Appl. No.: 685,153

[22] Filed: Jul. 23, 1996

[51] Int. Cl.[6] ..... B41J 13/08

[52] U.S. Cl. ..... 400/635; 271/7; 271/198; 400/636

[58] Field of Search ..... 400/635, 636, 400/637, 637.1; 101/425, 416.1; 271/7, 272, 275, 198

[56] References Cited

U.S. PATENT DOCUMENTS

| | | | |
|---|---|---|---|
| 4,697,944 | 10/1987 | Peebles et al. | 400/635 |
| 4,704,963 | 11/1987 | Nishimura et al. | 101/425 |
| 5,133,616 | 7/1992 | Oyaide et al. | 400/635 |
| 5,197,812 | 3/1993 | Worley et al. | 400/635 |
| 5,255,606 | 10/1993 | Ijima et al. | 101/425 |

FOREIGN PATENT DOCUMENTS

| | | | |
|---|---|---|---|
| 0038176 | 10/1981 | European Pat. Off. | 400/635 |

*Primary Examiner*—Christopher A. Bennett
*Attorney, Agent, or Firm*—Darby & Darby, P.C.

[57] ABSTRACT

A printing apparatus includes a transport for cards to be repeatedly scan printed with component colors. In the transport, a pair of belt rollers are fixed axially parallel in a frame, the belt rollers defining circumferential annular aligned grooves. Belts encircle the belt rollers, positioned in the grooves, and extend to define a virtual working bed on which the card is moved to be printed. Pinch rollers retain the card fixed to the belts. In sequence, cards are cleaned, magnetically processed and printed.

9 Claims, 3 Drawing Sheets

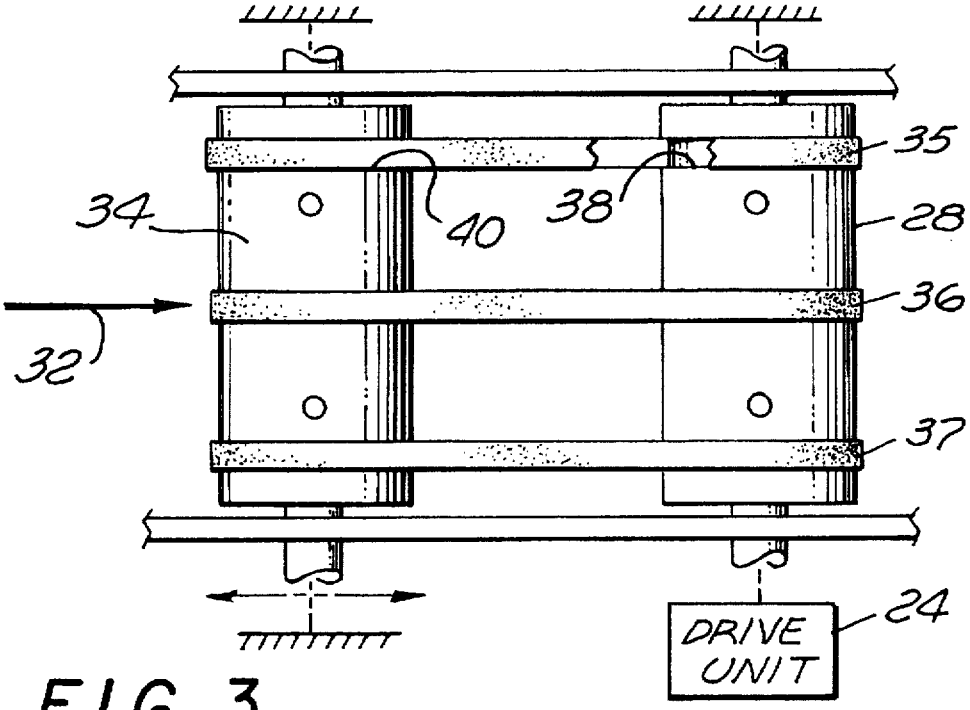
FIG. 3
FIG. 4
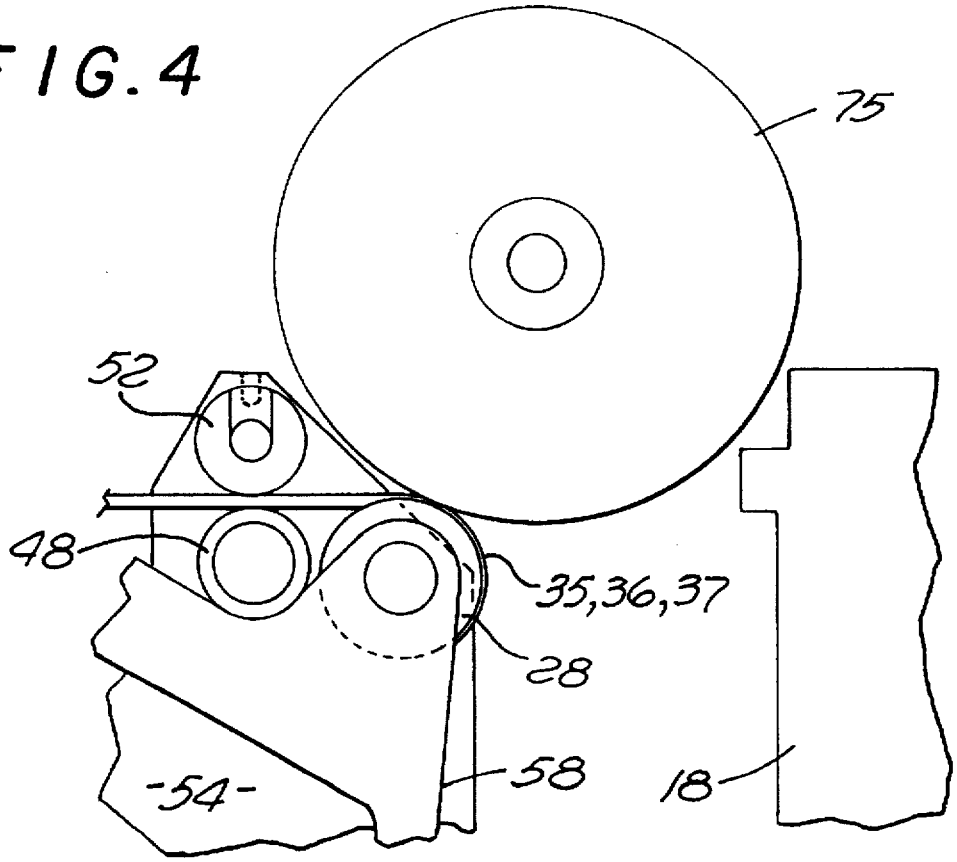

PRINTER BELT DRIVE FOR MOVING A CARD

BACKGROUND OF THE INVENTION

Generally, the invention relates to a belt transport for moving a document to attain various positions as with reference to print head.

A multitude of different structures have been proposed for moving documents relative to printing apparatus. In one class of apparatus, direct engagement rollers have been widely used, in relation to specific documents, forms of card printers have included direct-engagement roller apparatus for example, pairs of pinch rollers grasp and move a card in relation to a print unit. However, as different portions of the card are aligned for printing, it may be positioned to be held only by one pair of pinch rollers. Although such arrangements are satisfactory for many applications, certain difficulties are sometimes encountered, particularly in applications involving multiple passes, as for color printing.

Conventional methods for color printing involve multiple passes of the card or other document with respect to a printing apparatus. Typically, a different component color is printed during each pass of the document, ultimately to attain a desired range of color by overlays. Consequently, it is important to maintain registration between the card and the printing apparatus during the deposition of each individual component color. Typically, in such mechanisms, simple pinch roller transports involve some slippage with the consequence that maintaining registration presents a substantial problem. Accordingly, a need exists for an improved transport for moving cards through multiple passes with respect to a print head or other printing apparatus so as to accomplish registration of individual color runs.

SUMMARY OF THE INVENTION

In general, the transport of the present invention effectively combines rollers with a contact-belt to consistently move a card through several passes with respect to a print head. Accordingly, color registration is attained by the avoidance of slippage between the card and the transport mechanism.

In the disclosed embodiment, the transport incorporates a pair of spaced apart belt rollers mounted axially parallel and each defining a plurality of axially spaced-apart circumferential grooves, the grooves of the rollers being aligned. A plurality of individual belts are carried on the belt rollers in the spaced-apart circumferential grooves. Sets of pinch rollers grasp the belts between the belt rollers and a platen which faces a multiple color print head. A drive unit and control system actuates the transport mechanism so that a card is received on the belts which define a support bed. As the card is variously moved on the bed between the platen and the print head, the belts maintain a relationship with the card to attain color registration. Accordingly, a simple and economical device is provided for moving a card in relation to a print head to accomplish well registered color printing. As disclosed, the mechanism is integrated in a system for processing magnetic stripe cards to record the magnetic stripe and print the card.

BRIEF DESCRIPTION OF THE DRAWINGS

In the drawings, which constitute a part of this specification, an exemplary embodiment, exhibiting various subjectives and features hereof is set forth, specifically

FIG. 3 is a fragmentary top view of the mechanism of FIG. 2; and

FIG. 4 is a fragmentary side elevation similar to FIG. 2 showing a step in the process of producing a structure in accordance with the present invention.

DESCRIPTION OF THE DETAILED EMBODIMENT

A detailed illustrative embodiment of the present invention is disclosed herein; however, recognizing that a wide variety of specific embodiments are possible it is merely representative. Nevertheless, the illustrative embodiment is deemed to afford the best embodiment for purposes of disclosure and to provide a basis for the claims herein which define the scope of the present invention.

Figure 1:
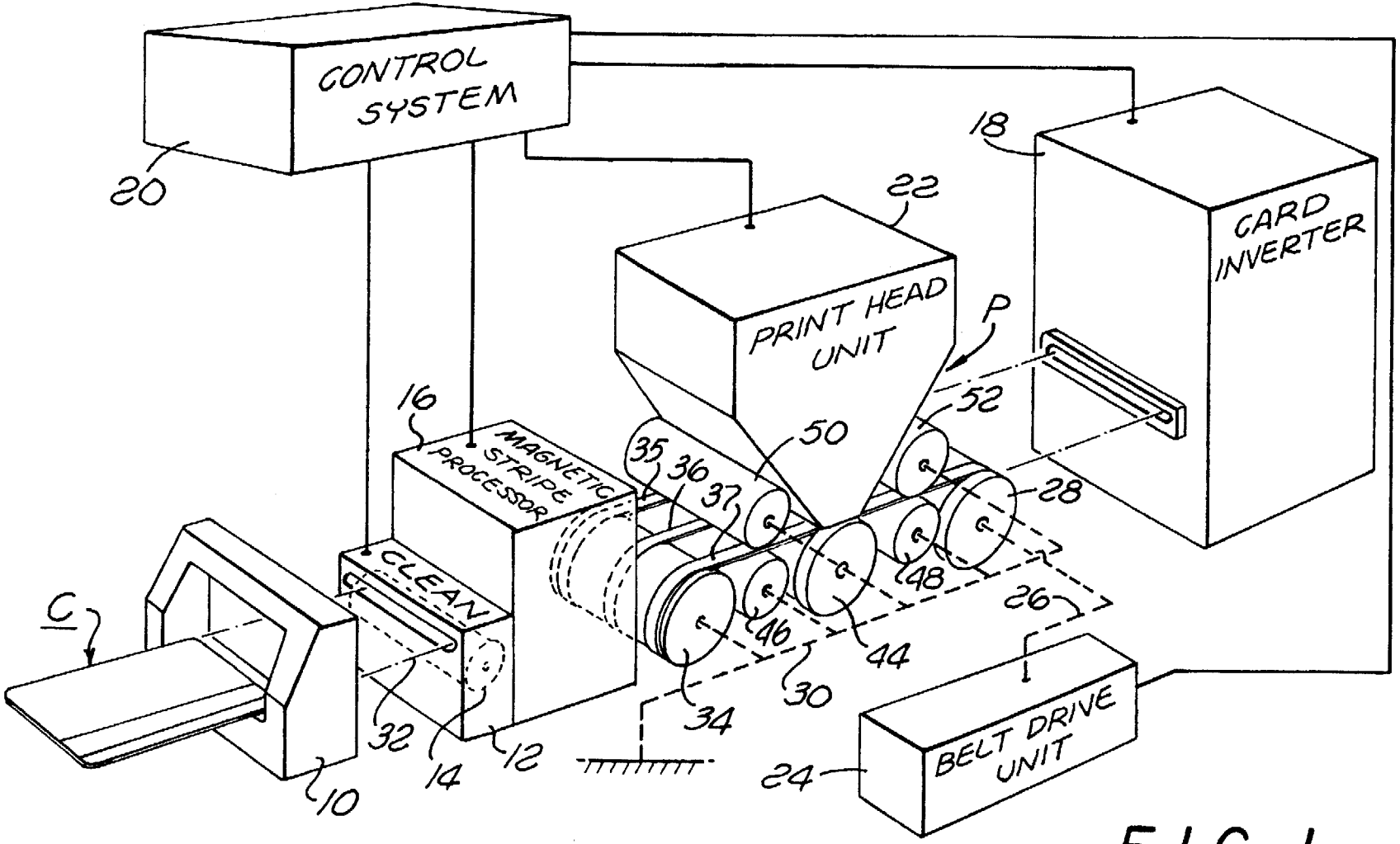
FIG. 1 is a perspective and diagrammatic view of a card processing system in accordance with the present invention.

Referring initially to FIG. 1, a transaction card C (lower left) is depicted entering the processing system for movement relative to individual stations as treated in detail below. The printing structure P (central) is shown in some detail and operates to accomplish color printing on either side of the card C. In that regard, the card is driven through multiple registered passes within the printing structure P to receive component colors attaining a desired print.

Considering the system in FIG. 1 in greater detail, the card C is manually inserted through a frame 10 to be received by a cleaning unit 12. Essentially, the card C is received in the cleaning unit 12 and propelled by a mechanism represented by a roller 14. Various forms of cleaning units are well known in the art, one such unit being shown and described in a copending patent application entitled TERMINAL FOR ISSUING AND PROCESSING DATA-BEARING DOCUMENTS, Ser. No. 08/594,812, Benson et al., commonly assigned herewith. Generally, the disclosure therein indicates detailed forms of certain components herein, except however, the printing structure P.

After cleaning, the card C passes to a magnetic stripe processor 16 where it is magnetically recorded then advanced to the printing structure P. Note that various forms of magnetic stripe processing apparatus are well known in the prior art which may function in the system of FIG. 1, as disclosed in the referenced Benson patent specification.

In the printing structure P, as indicated above, the card C is reciprocating through a number of aligned or registered passes to receive component colors, as disclosed in detail below. With the completion of printing operations on one side of the card C, it is passed to a card invertor 18 to be inverted and returned to the printing structure P for additional printing. Various forms of card inverters satisfactory for use as the card inverter 18 are well known in the art. After being printed on both sides, the card C may be returned through the frame 10 or passed through the card invertor 16 to be released.

The operations, as generally described above are implemented by a control system 20 (upper left) connected through a series of cables to each of the operating units. With regard to the printing structure P, the control system is connected to a print head unit 22 and a belt drive unit 24. As indicated by a dashed line 26, the belt drive unit 24 is connected to a belt drive roller 28. Generally, other rollers in the printing structure P, as described below, are mechanically supported for rotation as indicated by dashed lines 30.

Accordingly, the control system 20 energizes the belt drive unit 24 to actuate the drive roller 28 to variously position a card C for printing. In that regard, the belt drive unit 24 may incorporate a stepper motor to accomplish a precision drive utilizing techniques and apparatus as well known in the mechanical art.

Considering the printing structure P in somewhat greater detail, reference will now be made somewhat concurrently to FIGS. 1, 2 and 3. The belt drive roller 28 is mounted transverse to the path 32 of the card C as designated by dashed lines 32 (FIG. 1). In cooperation with a belt roller 34 (FIG. 3), the belt drive roller 28 carries three spaced-apart carrier belts 35, 36 and 37 extending parallel to the card path 32. The belt rollers 28 and 34 are mounted axially parallel in spaced-apart relationship.

Each of the rollers 28 and 34 define three spaced apart coaxial circumferential grooves aligned as between the rollers to receive the belts 35, 36 and 37. Specifically, the belt 35 is matingly received in circumferential (annular) grooves 38 and 40 of the rollers 28 and 34, respectively. The belts 36 and 37 are similarly received in similar pairs of aligned circumferential grooves defined in the rollers 28 and 34. Accordingly, the belts 35, 36 and 37 define a bed 42 (FIG. 2) extending tangentially between the belt rollers 28 and 34 to receive and carry cards CP1 and CP2. As the bed moves, a card C is accurately positioned with respect to the print head unit 22 and an aligned platen 44 beneath the belts 35, 36 and 37. While a card C is being variously transported on the belts 35, 36 and 37, it is fixed to the belts by two sets of pinch rollers as will now be described.

Figure 2:
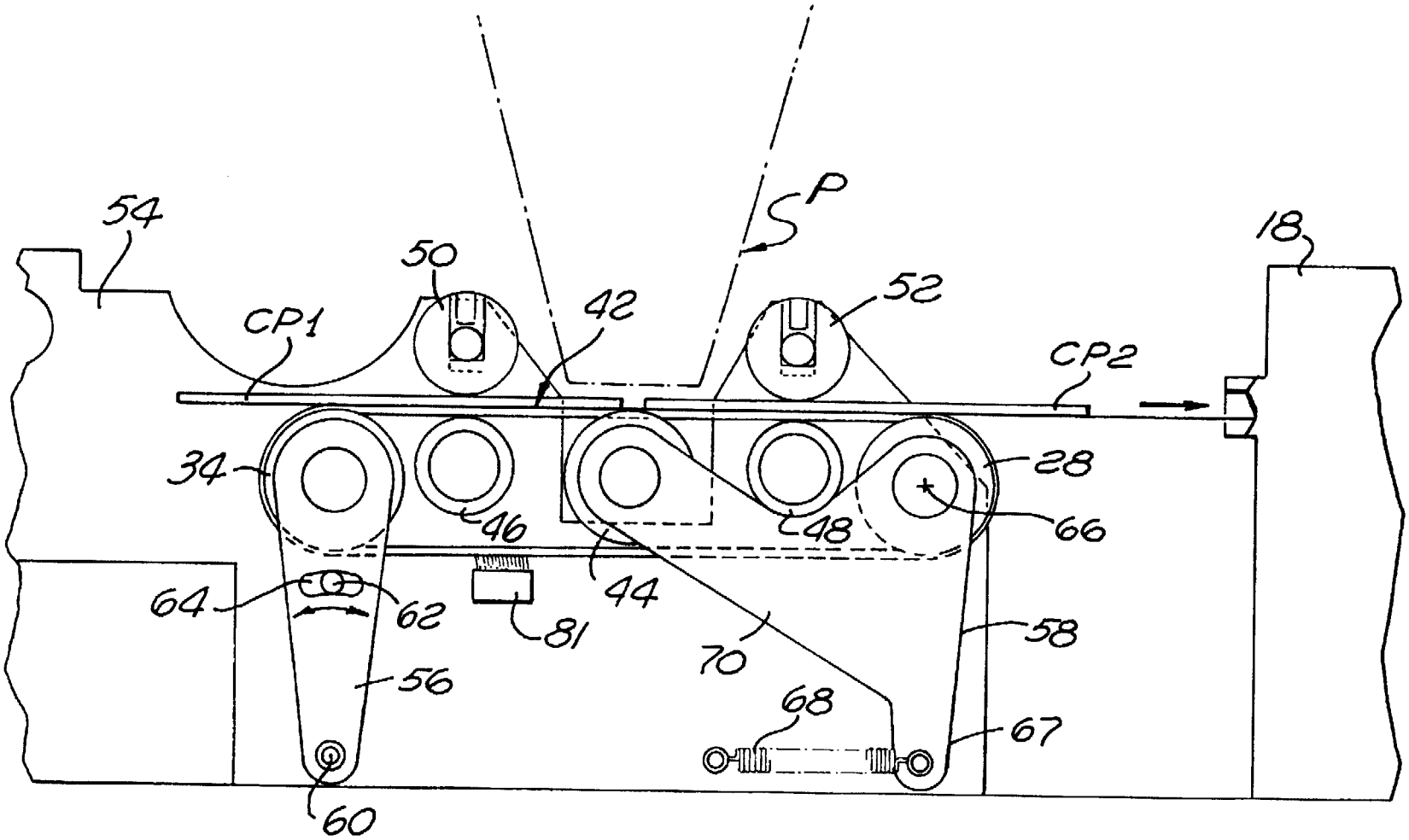
FIG. 2 is a fragmentary side elevation of the printer transport mechanism in the system of FIG. 1.

As shown in FIG. 2, a pair of back up rollers 46 and 48 are mounted axially parallel with the platen 44 and the belt rollers 28 and 34, each being located between a belt roller and the platen. The back-up rollers 46 and 48 respectively oppose horizontally offset pressure rollers 50 and 52 which are spring mounted so that the belts (along with a card C) are grasped between each set of rollers. Accordingly, a card C entering the printing structure P is grasped between the set of rollers 46 and 50 to be locked onto the bed 42 defined by the upper surfaces of the belts 35, 36 and 37. As the card C is reciprocated in the plane of the bed 42, with respect to the print head unit 22, one or both of the pinch roller sets maintain non slip engagement between the card and the belts.

Considering the mechanical structure in somewhat greater detail, the rollers are carried on a frame 54 (FIG. 2) with opposed bearing mounts (not shown) to carry each of the rollers as described above. On each side, affixed to the frame 54 are a pair of bell crank arms 58 (right, only one shown) that are pivotally affixed (at a pivot point 66) to the frame 54. The arms 58 support the platen 44 spring biased upwardly as disclosed in detail below. Additionally, a pair of arms 56 (left) on opposite sides of the frame 54 support the roller 34.

The opposed bell crank arms 58 are pivotally mounted on the frame F at the axis 66 of the belt drive roller 28. Lower extensions 67 of the arms 58 are coupled to the frame 54 by tension springs 68. Internal extensions 70 of the arms 58 carry the platen 44 for rotation. The arms 56 (left) on the opposite sides of the frame 54 accommodate parallel and aligned displacement of the roller 34 maintaining pressure on the underside of the belts and a captured card. Thus, the print head unit 22 (FIG. 1) receives backing support for the card by the belts and the upwardly biased platen 44.

Generally, to accommodate precision printing, the roller mechanism is manufactured to relatively high standards for a consistent operation. Essentially, the individual rollers are mounted in the frame 54 along with the arms 56 and 58 (FIG. 2). The subassembly is completed with the belts 35, 36 and 37 in position and the belt drive unit 24 operative. The rollers 28 and 34 are aligned by pivoting the arms 56 to also tension the belts. With the subassembly complete, the belts 35, 36 and 37 are abrasively ground to provide the bed 42 uniform. In that regard, as illustrated in FIG. 4, a grinding wheel 75 is swung into aligned contact with the belts 35, 36 and 37. As the belts revolve they are ground to accomplish a uniformly defined surface. Generally, an inelastic belt has been used in one embodiment, a laminar belt has been employed to provide an interior friction or gripping surface (for engaging the belt rollers 28 and 34) in an external rubber like surface for engaging the card C. Accordingly, the grinding wheel 75 removes irregularities from the belts as they occur in a mounted configuration to accomplish the uniform bed 42 (FIG. 2) as described above.

With the subassembly of the transport completed, the printer unit is mounted in a composite machine as illustrated in FIG. 1.

A brush 81 is mounted on the underside of the mechanism to clean the external surfaces of the belts 35, 36 and 37. Accordingly, cards C are processed as will now be described.

The insertion of a card C (FIG. 1) is sensed to actuate the control system 20 (as well known in the art) motivating the cleaning unit 12 and magnetic stripe processor 16 respectfully to clean the card and record the magnetic stripe as desired. Generally, such techniques are well known and in that regard various forms of magnetic stripe processing apparatus have been available for a number of years from Mag-Tek, Inc. of Carson, Calif.

Moving from the processor 16, the card passes onto the belts 35, 36 and 37 to be grasped between the belts and the initial pressure roller 50. The control system 20 then actuates the belt drive unit 24 to move the card through an initial scanning stroke under the print head 22 to deposit an initial color on the card. With the completion of the scan stroke, the card is moved from a position of card CP1 (FIG. 2) to a position of card CP2 during which the initial color is scan printed.

With the completion of the stroke, the control system 20 actuates the belt drive unit 24 to reverse the direction of motion, moving the card C in a return stroke back to the position of the card CP1.

Another color may be deposited during the return stroke, or depending on the function of the print head unit 22, color may be deposited only during forward strokes. The operation is a matter of design. In any event, the control system implements numerous reciprocal strokes or passes of the card C under the printhead 22 between the positions of cards CP1 and CP2. During the passes, component colors are printed on the card to complete a color image and may be followed by a transparent protective coating that also is deposited by the print head unit 22.

At the conclusion of the printing operation, the card is advanced to the card inverter 18 at which stage the operation may be complete, or the card may be inverted and returned for another series of printing strokes on the opposed side. Again, specific operation will be provided in accordance with design considerations. With the card printed, it is variously returned or stored.

In the operation of the printing structure P, as described above, very good color registration has been attained. In that regard, the combination of the belts, pinch rollers and drive rollers limit the slippage of the card with respect to the bed 42 maintaining the desired relationship to print head unit 20 thereby attaining effective and reliable printing operations.

In view of the above explanations and descriptions, it will be apparent that the system of the present invention enables an effective printing transport for use in document processors including card processors. Also, the system provides good registration with economy and durability. In that regard, recognizing the significance of various aspects of the system, it is to be understood that a wide variety of techniques and individual apparatus may be employed in accordance with the principles of the present invention depending on specific design objectives, structures and operating formats. Consequently, the scope hereof is deemed to be appropriately determined by the claims as set forth below.

What is claimed is:

1. A printer transport for moving a card, or the like, to attain various movements as with reference to a print head, comprising:

a pair of belt rollers disposed in spaced apart, axially parallel relationship and defining respective pairs of spaced-apart coaxial circumferential grooves in relative radial alignment;

a plurality of belts mounted on said belt rollers in said spaced-apart circumferential grooves;

at least one set of pinch rollers mounted on opposite sides of said belts and axially parallel to said belt rollers to receive a card on said belt in rolling engagement; and a drive mechanism for rotating said belt rollers whereby to move said belt and position a card variously with respect to said print head.

2. A transport according to claim 1 further including a platen mounted between and axially parallel to said pair of belt rollers.

3. A transport according to claim 2 further including a print head mounted in facing relationships to said platen.

4. A transport according to claim 3 further including a central system for actuating said print head and said drive mechanism to scan print said card.

5. A transport according to claim 4 wherein said print head comprises a multiple color print head for printing said card in color during multiple passes of said card as moved by said drive mechanism.

6. A transport according to claim 4 further including an invertor controlled by said control system for inverting said card to accomplish printing on both sides.

7. A transport according to claim 4 further including a magnetic stripe processor controlled by said control unit to process said card.

8. A transport according to claim 1 further including a cleaning brush engaging said belts.

9. A transport according to claim 1 including two sets of pinch rollers to receive a card along with said belts, said belts extending tangentially between said belt rollers to define a flat bed, and said sets of pinch rollers disposed intermediate said belt rollers to immobilize said card against said bed.

* * * * *